US008747161B2

(12) United States Patent
Yu et al.

(10) Patent No.: US 8,747,161 B2
(45) Date of Patent: Jun. 10, 2014

(54) ELECTRICAL CONNECTOR HAVING SMALL SIZE

(75) Inventors: Jian-Fei Yu, Kunshan (CN); Qi-Jun Zhao, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 168 days.

(21) Appl. No.: 13/349,583

(22) Filed: Jan. 13, 2012

(65) Prior Publication Data

US 2012/0184146 A1 Jul. 19, 2012

(30) Foreign Application Priority Data

Jan. 19, 2011 (CN) ..... 2011 2 0016941

(51) Int. Cl.
*H01R 24/00* (2011.01)

(52) U.S. Cl.
USPC ..... 439/630

(58) Field of Classification Search
USPC ..... 439/660, 862, 630
See application file for complete search history.

(56) References Cited

U.S. PATENT DOCUMENTS

| | | | | |
|---|---|---|---|---|
| 5,746,626 | A * | 5/1998 | Kwiat et al. | 439/630 |
| 6,409,546 | B1 * | 6/2002 | Ito et al. | 439/630 |
| 6,702,621 | B2 * | 3/2004 | Yeh | 439/660 |
| 6,988,916 | B2 * | 1/2006 | Taguchi | 439/862 |
| 6,991,472 | B2 * | 1/2006 | Du et al. | 439/66 |
| 7,396,245 | B2 * | 7/2008 | Huang et al. | 439/188 |
| 7,416,428 | B1 * | 8/2008 | Hung et al. | 439/188 |
| 7,438,600 | B1 * | 10/2008 | Hung et al. | 439/630 |
| 7,628,624 | B2 * | 12/2009 | Ye et al. | 439/137 |
| 7,938,698 | B1 * | 5/2011 | Yu | 439/862 |
| 8,529,298 | B2 * | 9/2013 | Zhu et al. | 439/630 |
| 2002/0048999 | A1 * | 4/2002 | Ming-Hui | 439/660 |
| 2007/0037439 | A1 * | 2/2007 | Hsu | 439/489 |
| 2007/0111603 | A1 * | 5/2007 | Wang | 439/630 |
| 2008/0090437 | A1 * | 4/2008 | Huang et al. | 439/188 |
| 2010/0210145 | A1 * | 8/2010 | Wang et al. | 439/630 |

FOREIGN PATENT DOCUMENTS

| | | |
|---|---|---|
| TW | 363706 | 9/2009 |

* cited by examiner

*Primary Examiner* — Briggitte R Hammond
(74) *Attorney, Agent, or Firm* — Wei Te Chung; Ming Chieh Chang

(57) ABSTRACT

A card connector (100) includes an insulative housing (1), a number of conductive contacts (2) retained in the insulative housing (1) and a shell (3) enclosing over the insulative housing (1). The shell (3) includes a top wall (31) and a pair of side walls (32) downwardly extending from two sides of the top wall (31). The side wall (32) has a latching arm (36) at the bottom thereof to upwardly abut against a bottom face (12) of the insulative housing (1). The insulative housing (1) has a top surface (11) facing the top wall (31). The top surface (11) and the top wall (31) define a receiving cavity (30) to receive an electrical card. The side wall (32) also has a limiting portion (33) extending into the receiving cavity (30) and downwardly abutting against the top surface (11) of the insulative housing (1). Therefore, the size of the card connector (100) is smaller which is in favor of a small-scale development of the card connector (100).

16 Claims, 5 Drawing Sheets

ELECTRICAL CONNECTOR HAVING SMALL SIZE

BACKGROUND OF THE INVENTION

1. Field of the Invention

The present invention generally relates to a card connector and more particularly to a card connector having small size.

2. Description of Related Art

Taiwan patent issue No. M363706, issued on Sep. 2, 2009, discloses a conventional card connector including an insulative housing, a plurality of contacts retained in the insulative housing and a shell attached to the insulative housing. A receiving cavity is formed between the insulative housing and the shell. The insulative housing has a top surface, a bottom surface, two side surfaces connecting the top surface and the bottom surface, and a recess depressing inwardly from the side surface. The shell has a top wall located over the receiving cavity, two side walls extending downwardly from a side of the top wall. The side wall further has a tearing portion abutting against the recess and two latching arms locking a bottom of the insulative housing. In this arrangement, the insulative housing can be positioned between the tearing portion and the latching arm. However, the recess depressing on a side of the insulative housing makes the thickness of the insulavtive housing larger and not easy to be reduced. The card connector can not keep a well contacting with an electrical card stationary for the tearing portion does not extend into the receiving cavity to limit two sides of the electrical card.

It is thus desired to provide a card connector having small size.

SUMMARY OF THE INVENTION

The present invention provides a card connector comprising an insulative housing having a top surface and a bottom portion opposite to the top surface. A shell comprising a top wall and a pair of side walls extending from both side edge of the top wall, a receiving cavity defined between the top surface and the top wall for receiving an electric card, a latching arm set at bottom of the side wall for engaging with the bottom portion of the insulative housing. A plurality of contacts retained in the insulative housing and extending into the receiving cavity for conductively contacting with the electric card. The side wall further comprising a limiting portion extending into the receiving cavity for abutting against with the top surface of the insulative housing downwardly.

Other objects, advantages and novel features of the present invention will become more apparent from the following detailed description of the present embodiment when taken in conjunction with the accompanying drawings.

DETAILED DESCRIPTION OF THE INVENTION

Figure 1:
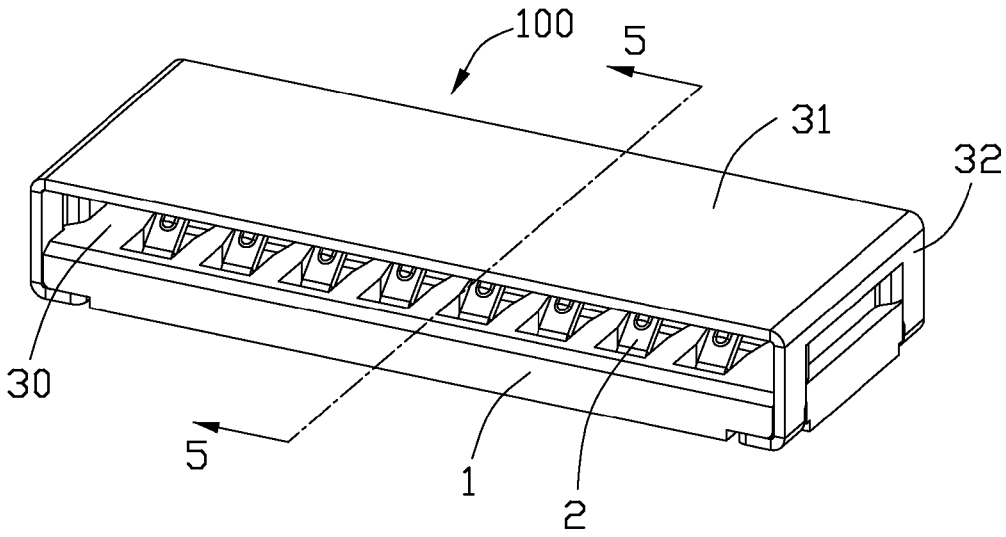
FIG. 1 is an assembled perspective view of a card connector according to a preferred embodiment of the present invention.
Figure 2:
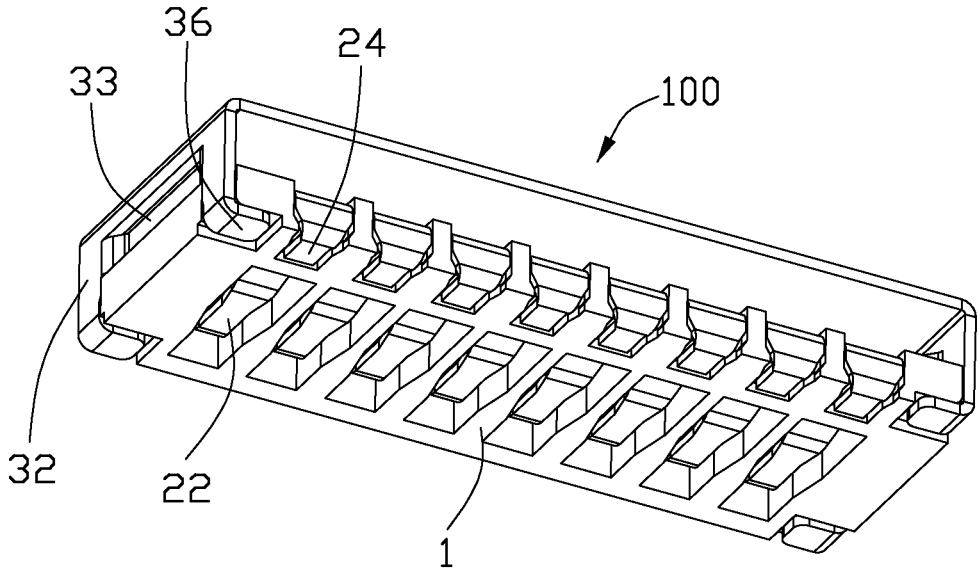
FIG. 2 is another assembled perspective view of the card connector as shown in FIG. 1 taken from another view.

Reference will now be made to the drawing figures to describe the preferred embodiment of the present invention in detail.

Referring to FIGS. 1-5, a card connector 100 includes an insulative housing 1, a plurality of conductive contacts 2 mounted on the insulative housing 1 and a shell 3 enclosing the insultive housing 1.

Figure 3:
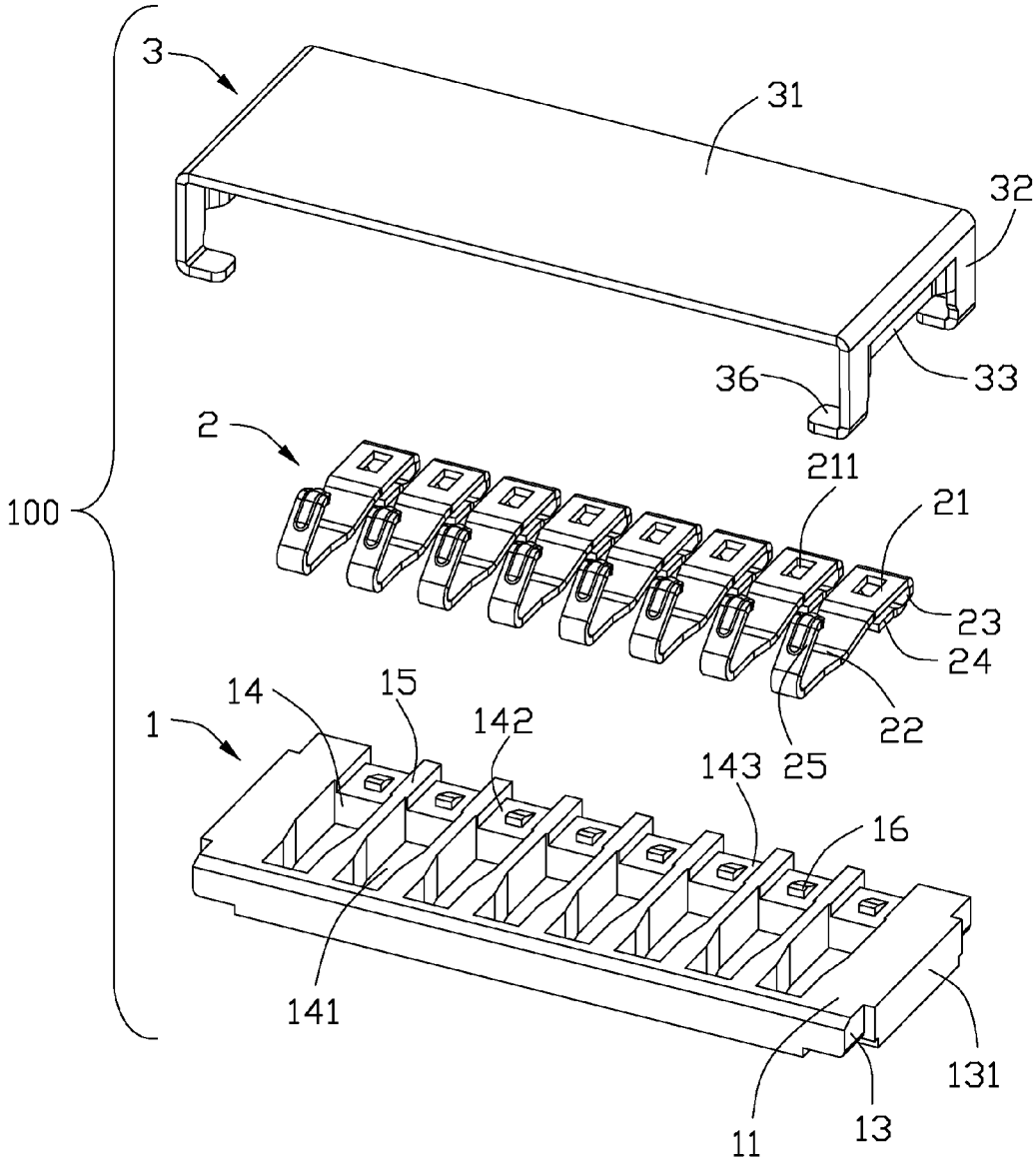
FIG. 3 is an exploded perspective view of the card connector.
Figure 4:
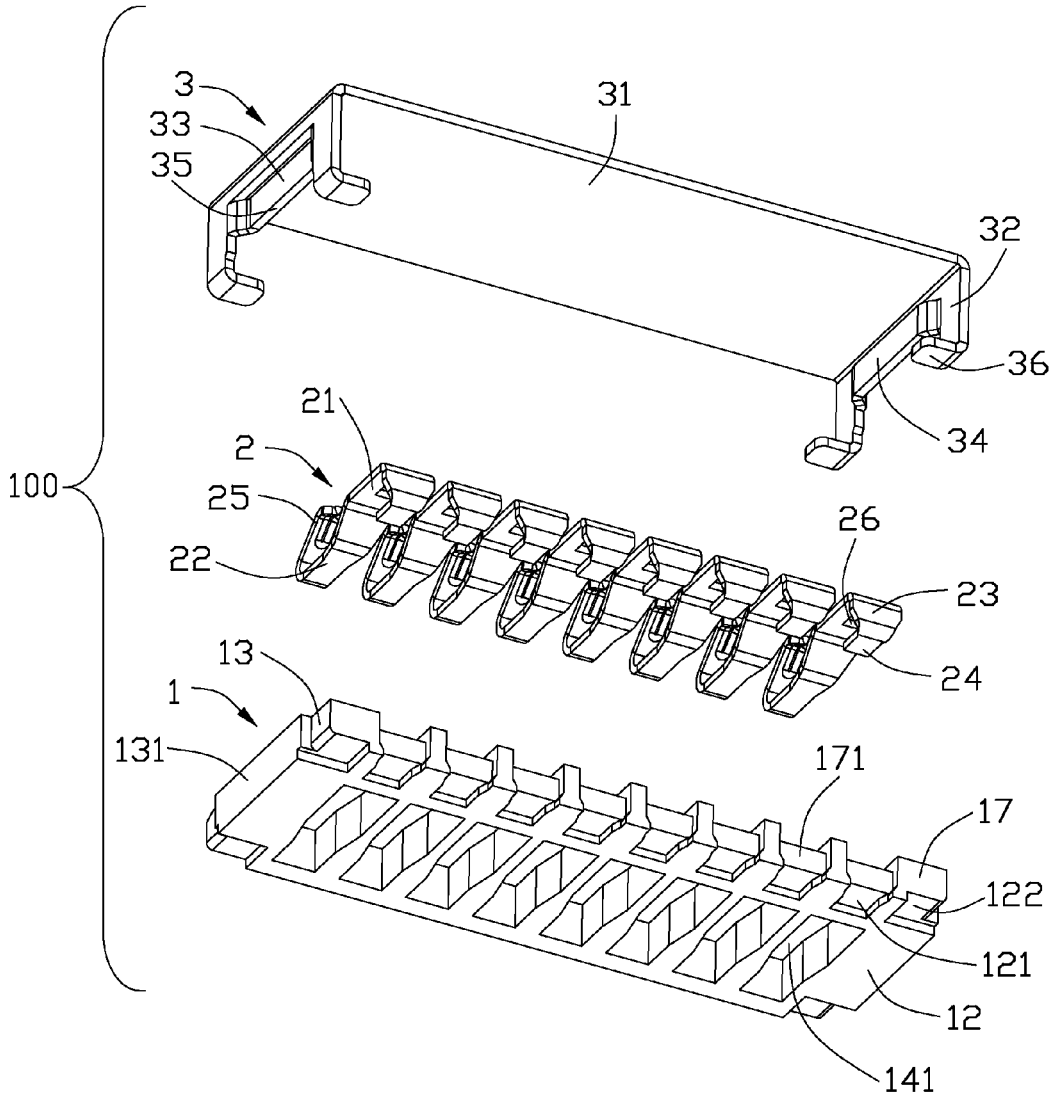
FIG. 4 is another exploded perspective view of the card connector, while taken from a different aspect.
Figure 5:
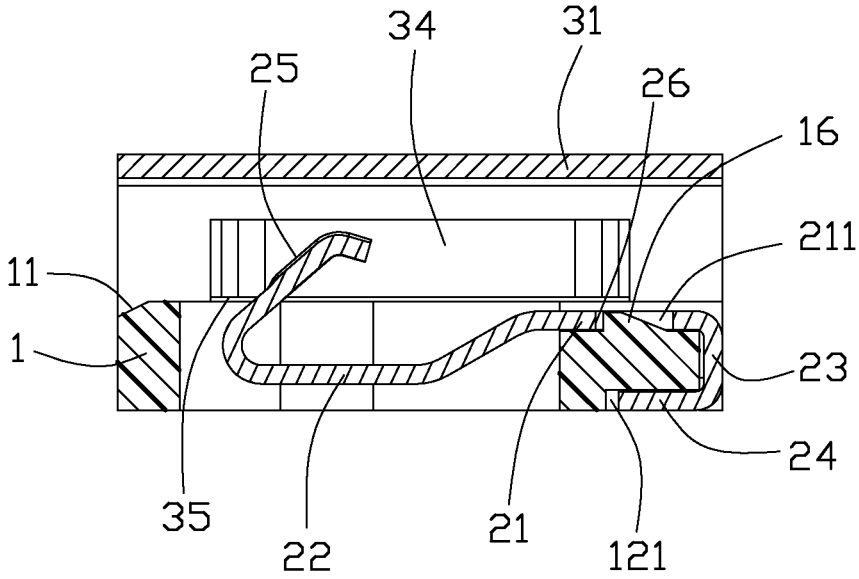
FIG. 5 is a cross-sectional view of the card connector taken along line 5-5 of FIG. 1.

Please referring to FIGS. 3-5, the insulative housing 1 has a top surface 11, a bottom face 12, a pair of side surfaces 13 connecting the top surface 11 and the bottom face 12, and a back end face 17. A plurality of receiving passageways 14 depressed downwardly from the top surface 11 for receiving the conductive contacts 2, and a plurality of traverse portions 15 are arranged between adjacent receiving passageways 14. The receiving passageways 14 comprise a plurality of first receiving cavities 142 located in a back of the insulative housing 1 and a plurality of second receiving cavities 141 located in a front of the insulative housing 1. The second receiving cavities 141 extending through the top surface 11 and the bottom face 12. The first receiving cavity 142 comprises a bottom wall 143 and a fitting portion 16 protruding upwardly from the bottom wall 143 of the insulative housing 1.

The insulative housing 1 has a pair of protrusions 131 laterally protruding from the side surfaces 13, a plurality of receiving grooves 171 depressing from the back end face 17 and located between adjacent traverse portions 15, and a plurality of notches 121 located under the bottom wall 143 and depressing upwardly from the bottom face 12. The receiving groove 171, the receiving passageway 14 and the notch 121 communicate with each other and are aligned with each other. A plurality of locking recesses 122 are recessed upwardly from four corners of the bottom face 12 to engage with the shell 3.

Please reference to FIGS. 2-5, the conductive contact 2 comprises a retaining portion 21 retained in the first receiving cavity 142, an extending portion 22 extending forwardly from a front of the retaining portion 21 and received in the second receiving cavity 141, a soldering portion 24 extending forwardly from a back of the retaining portion 21 and received in the notch 121, and a connecting portion 23 connecting the soldering portion 24 and the retaining portion 21. The soldering portion 24 is under the retaining portion 21. The contact 2 also has a contacting portion 25 extending backwardly from a front end of the extending portion 22. The retaining portion 21 has a through hole 211 extending through thereof along a top to bottom direction to lock and surround the fitting portion 16. A confronting portion 26 engaging backwardly with the fitting portion 16 is formed at a front edge of the through hole 211. The contact 2 is assembled in the insulative housing 1 along a back-to-front direction, the confronting portion 26 abuts against with the fitting portion 16 to prevent the contacts 2 from moving backwardly. The connecting portion 23 is positioned by the adjacent traverse portion 15 along a left-to-right direction and received in the receiving groove 171 of the insulative housing 1 to prevent the contacts 2 from moving forwardly. The retaining portion 21 and the soldering portion 24 form an U shape configuration and clamp the insulative housing 1 along the top to bottom direction. By this arrangement, the contact 2 is simple in structure and easy to be installed into the insulative housing 1.

Please reference to FIGS. 1-4, the shell 3 comprises a top wall 31 and a pair of side walls 32 extending form two sides of the top wall 31. A receiving cavity 30 defined between the top surface 11 of the insulative housing 1 and the top wall 31 for receiving an electric card (not shown), the side wall 32 further comprising a limiting portion 33 extending into the receiving cavity 30 for abutting against with the top surface 11 of the insulative housing 1. The limiting portion 33 is formed by tearing the side wall 32 from an intermediate thereof, a front and a rear sides of the limiting portion 33 still connect with the side wall 32, and an upper and a lower sides of the limiting portion 33 are separated from the side wall 32. Each side wall 32 comprises a pair of horizontal latching arms 36 set in a front and a rear ends thereof, the latching arm 36 extending inwardly to lock with the insulative housing 1, the limiting portion 33 located between the two latching arms 36 in a front-to-back direction has a limiting planar surface 34 facing the receiving cavity 30 for positioning the electric card. A bottom surface 35 of the limiting portion 33 abuts against the top surface 11 downwardly and the latching arms 36 received in the notches 121 of the bottom face 12, in this arrangement, the insulative housing 1 is positioned in the shell 3 stationary. The latching arms 36 located at one side of the insulative housing 1 abut against with a front and a back sides of the protrusion 131 in a transverse direction of the insulative housing 1 to prevent the insulative housing 1 from a front-to-back movement. An outside surface of the latching arm 36 and an outside face of the protrusion 131 are coplanar.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A card connector comprising:

an insulative housing having a top surface and a bottom face opposite to the top surface;

a shell comprising a top wall and a pair of side walls extending from both side edge of the top wall, a receiving cavity defined between the top surface and the top wall for receiving an electric card, a latching arm set at a bottom of the side wall to engage with the bottom face of the insulative housing;

a plurality of contacts retained in the insulative housing and extending into the receiving cavity for electrically contacting the electric card; and the side wall further comprising a limiting portion extending into the receiving cavity and downwardly abutting against the top surface of the insulative housing.

2. The card connector as claimed in claim 1, wherein the limiting portion has a limiting surface facing the receiving cavity for positioning the electric card and a bottom surface abutting against with the top surface of the insulative housing.

3. The card connector as claimed in claim 1, wherein the limiting portion extending into the receiving cavity is formed by tearing the side wall from a middle portion of the side wall, a front and a rear sides of the limiting portion connect with the side wall, and an upper and a lower sides of the limiting portion are separated from the side wall.

4. The card connector as claimed in claim 3, wherein each side wall comprises a pair of the latching arms set in a front and a rear thereof respectively, the latching arm extending inwardly to upwardly abut against and lock with the insulative housing, the limiting portion is located between the two latching arms in a front-to-back direction.

5. The card connector as claimed in claim 4, wherein the insulative housing has two side surfaces connecting the top surface and the bottom face, and a protrusion protruding from each side surface, the latching arms located at one side of the insulative housing abut against a front and a rear sides of the protrusion in the front-to-back direction of the insulative housing.

6. The card connector as claimed in claim 5, wherein an outside surface of the latching arm and an outside face of the protrusion are coplanar.

7. The card connector as claimed in claim 5, wherein the insulative housing further defines a plurality of locking recesses depressed upwardly from the bottom face of the insulative housing to engage with the latching arms.

8. The card connector as claimed in claim 5, wherein the contact has a retaining portion, a soldering portion located at a free end of the retaining portion and a contacting portion located in a front side of the retaining portion, a fitting portion protruding upwardly from a bottom of the insulative housing, the retaining portion has a through hole locking and surrounding the fitting portion.

9. The card connector as claimed in claim 8, wherein the contact also comprises a connecting portion connecting the retaining portion and the soldering portion along a top to bottom direction, and an extending portion extending forwardly from the retaining portion and received in a receiving passageway defined on the insulative housing, the contacting portion extends backwardly from a front end of the extending portion.

10. The card connector as claimed in claim 9, wherein the insulative housing comprises a back end face to connect the top surface and the bottom face, and a receiving groove depressed forwardly from the back end face, the connecting portion are received in the receiving groove.

11. A card connector comprising:

an insulative housing having a top surface and a bottom face;

a shell enclosing the insulative housing, a receiving cavity formed between the shell and the insulative housing;

a plurality of conductive contacts retained in the insulative housing; wherein the shell comprises a pair of side walls located besides two sides of the insulative housing, each side wall further comprising a limiting portion extending into the receiving cavity and downwardly abutting against with the top surface of the insulative housing and a latching arm set at the bottom of the side wall and engaging with the bottom face of the insulative housing, the insulative housing is sandwiched between the limiting portion and the latching arm along the top to bottom direction.

12. The card connector as claimed in claim 11, wherein the insulative housing has a top surface, and the limiting portion has a limiting surface facing the receiving cavity and a bottom surface abutting against the top surface of the insulative housing.

13. An electrical connector for mounting to a printed circuit board, comprising:

an insulative housing defining an upper mating face and a bottom mounting face opposite to each other in a vertical direction;

a metallic shell assembled upon the housing to shield the upper mating face in the vertical direction with a receiving cavity therebetween for receiving a card; and a plurality of terminals disposed in the housing with contacting sections extending upwardly above the upper mating face and into the receiving cavity; wherein the terminals define horizontal soldering portions for mounting to the printed circuit board, and the shell defines horizontal latching arms for securing the shell to the housing under condition that both said horizontal soldering portions and said horizontal latching arms are hidden underneath the housing; wherein the terminal defines a horizontal U-shaped configuration, including the corresponding horizontal soldering portion, for securely sandwiching the housing; wherein the housing and the corresponding terminal are configured to have the terminal assembled into the corresponding passageway initially downwardly and successively forwardly instead of simply forwardly; wherein an opening is formed in one of an upper arm of the U-shaped configuration and the upper mating face of the housing, and a wedge structure is formed the other of said upper arm and said upper mating face to be received in said opening so as to secure the terminal to the housing without rearward withdrawal.

14. The electrical connector as claimed in claim 13, wherein the shell defines a limiting device to downwardly abut against the upper mating face of the housing.

15. The electrical connector as claimed in claim 13, wherein the housing defines plurality of passageways to receive the corresponding terminals, and said passageway extends through the housing in the vertical direction for allowing downward deflection of the contacting section during mating.

16. The electrical connector as claimed in claim 13, wherein the horizontal soldering portion extends from the corresponding terminal forwardly while the horizontal latching arm extends from the shell transversely.

* * * * *